US008943976B2

(12) United States Patent
Comorre

(10) Patent No.: US 8,943,976 B2
(45) Date of Patent: Feb. 3, 2015

(54) FLYING ROLLER COASTER WITH VERTICAL LOAD AND LAUNCH

(71) Applicant: Disney Enterprises, Inc., Burbank, CA (US)

(72) Inventor: Nicholas J. Comorre, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 197 days.

(21) Appl. No.: 13/716,509

(22) Filed: Dec. 17, 2012

(65) Prior Publication Data

US 2014/0165868 A1 Jun. 19, 2014

(51) Int. Cl.

| | |
|---|---|
| ***A63G 1/00*** | (2006.01) |
| ***A63G 7/00*** | (2006.01) |
| ***A63G 21/20*** | (2006.01) |

(52) U.S. Cl.

CPC . *A63G 7/00* (2013.01); *A63G 21/20* (2013.01)
USPC ..... 104/53; 104/69

(58) Field of Classification Search

USPC ..... 104/53, 63, 75, 60, 55, 69, 57; 472/43–45

See application file for complete search history.

(56) References Cited

U.S. PATENT DOCUMENTS

| | | | | |
|---|---|---|---|---|
| 4,165,695 | A * | 8/1979 | Schwarzkopf | 104/55 |
| 5,853,331 | A * | 12/1998 | Ishikawa et al. | 472/88 |
| 5,979,333 | A * | 11/1999 | Houben et al. | 104/63 |
| 6,348,004 | B1 * | 2/2002 | Houben | 472/43 |
| 6,402,624 | B1 * | 6/2002 | Larson et al. | 472/44 |
| 6,405,655 | B1 * | 6/2002 | Clerx et al. | 104/63 |
| 6,513,441 | B1 * | 2/2003 | Clerx et al. | 104/53 |
| 6,523,479 | B1 * | 2/2003 | Schilke et al. | 104/57 |
| 7,640,862 | B2 * | 1/2010 | Zamperla | 104/53 |
| 7,980,181 | B2 * | 7/2011 | Heaslip et al. | 104/63 |
| 8,141,495 | B2 * | 3/2012 | Baker et al. | 104/75 |
| 2005/0274275 | A1 * | 12/2005 | Gordon | 104/53 |
| 2006/0137563 | A1 * | 6/2006 | Cummins | 104/53 |
| 2006/0178221 | A1 * | 8/2006 | Threlkel | 472/1 |
| 2007/0199474 | A1 * | 8/2007 | Zamperla | 104/53 |
| 2008/0143158 | A1 * | 6/2008 | Roodenburg et al. | 297/284.4 |
| 2009/0031913 | A1 * | 2/2009 | Heaslip et al. | 104/63 |
| 2011/0048274 | A1 * | 3/2011 | Roodenburg et al. | 104/53 |
| 2012/0071251 | A1 * | 3/2012 | Crawford et al. | 472/45 |
| 2014/0165868 | A1 * | 6/2014 | Comorre | 104/69 |

FOREIGN PATENT DOCUMENTS

| | | |
|---|---|---|
| GB | 137971 | 1/1920 |
| WO | 9922831 | 5/1999 |
| WO | 2004035164 | 4/2004 |

* cited by examiner

*Primary Examiner* — Jason C Smith
(74) *Attorney, Agent, or Firm* — Marsh Fischmann & Breyfogle LLP; Kent A. Lembke

(57) ABSTRACT

A ride system for giving passengers a flying roller coaster experience. The ride system includes a train of vehicles, with each of the vehicles including seat assemblies that each has a seat and seat back for receiving a passenger. The vehicles are supported by the track to roll along a length of the track, and the ride path is adapted for gravity-based movement of the train of vehicles in at least portions of the ride path. The track includes a vertical segment, and the ride system includes a station including a platform assembly with horizontal platforms vertically spaced-apart to provide multi-level loading. The train is positioned on the vertical segment with each of the vehicles proximate to an end of one of the horizontal platforms. The seat backs are substantially parallel to a longitudinal axis of the track to provide vertical loading and, then, vertical launching from the station.

18 Claims, 7 Drawing Sheets

FLYING ROLLER COASTER WITH VERTICAL LOAD AND LAUNCH

BACKGROUND

1. Field of the Description

The present invention relates, in general, to track-based rides used to simulate flying such as gravity coasters sometimes called flying roller coasters, and, more particularly, to a flying roller coaster adapted for vertical launching and for vertical loading and unloading of passengers from ride vehicles.

2. Relevant Background

Roller coasters are included in many theme or amusement park rides to provide visitors a thrill ride. Generally, a roller coaster includes a train of vehicles that are supported upon a track so as to roll along a ride path defined by the track. In most roller coasters, the train is loaded with passengers in a station with a horizontally-oriented platform and with the track positioning the vehicles in a horizontal position for easy loading. A launch mechanism is then used to launch the vehicle to start the ride (e.g., lift the vehicle train to a high point of the ride path), and gravity causes the vehicle to follow the track through the ride path and to eventually return to the load/unload platform for unloading.

Flying roller coasters are variations of roller coasters configured to simulate flight by harnessing passengers in a prone position (e.g., leaning forward for much of the ride). The roller coaster vehicles or cars are typically suspended below the track with the seat backs parallel to the track, with passengers or riders restrained in their seats (e.g., with their backs substantially parallel to the track and facing downward in horizontal runs of the ride's track). The flying roller coaster is a relatively new ride for amusement parks, and ride designers have faced several challenges including how to load and unload the vehicles and then place the passengers/riders in a prone or flying position.

In one of the first flying roller coasters, four-across seating was provided in each vehicle in the coaster train. Passengers load the trains from a platform along a horizontal stretch of track, with the seats arranged such that the passengers face the rear of the train. A lap bar and chest harness are used to restrain the passengers in their seats. After the train leaves the loading station and begins an ascent up a lift hill for launch, actuators (e.g., hydraulic pistons) in the vehicles lower the seats toward the track with the passengers positioned horizontally facing upward. After cresting the lift/launch hill portion of the track, the track twists 180 degrees to flip the passengers into the flying or prone position. Prior to reaching the roller coaster's final brake run, the track twists again, and the passengers are again positioned on their backs facing upward. After or during braking, the actuators operate to raise the seats back to the load/unload position so that the passengers can unload in the station.

In another design, each rider takes a sitting position in a vehicle when the coaster train is moved onto a horizontal run of track next to a loading platform of a station. The train is supported below the track in the station, and the seats or the entire vehicles are rotated downward away from the track such that the seat backs are generally vertical. When seated, the rider's legs are dangling in a manner similar to typical inverted roller coasters. Once the riders are properly restrained in their seats (e.g., with a harness that may include a padded vest and flaps to hold the legs in position), mechanisms or actuators pivot the seats or vehicles up toward the track so as to position the seat backs to be parallel to the track.

The riders are now in the prone or flying position for the duration of the ride. The reverse process is used for unloading.

SUMMARY

The inventor identified a number of design problems with prior flying roller coasters. First, the loading and unloading positions can be quite uncomfortable as some existing designs require the passengers to lie down in the vehicle. Second, many flying roller coasters have vehicles with complex actuator assemblies that are used to position the vehicles or seats in a flying position after passenger loading is completed. This increases manufacturing and maintenance costs for these rides. Third, all of the passengers load the vehicles or cars of the coaster train from a single station (or single horizontal platform). Such an arrangement fails to provide any privacy for the vehicle passengers during loading and unloading. For example, each passenger has to share the pre-ride experience with a large number of people (i.e., the entire capacity of the train rather than just those in your family or group that may be entering a car or vehicle to experience a ride).

Briefly, a design is presented for a gravity-based, flying roller coaster (or ride system) that includes a vertical launch. Significantly, the flying roller coaster differs from typical flying roller coasters because loading and unloading is provided in a vertical track segment, and, then, launching is performed upward or vertically out of the station. The load/unload segment of the track (which may also be the launch segment of track) runs through or adjacent to the station, and, when a train of vehicles or cars passes into and is locked into the station, the vehicles are arranged or positioned such that the seat backs of the vehicles' seat assemblies are substantially vertical (i.e., the seat backs are substantially vertical to the track, which is vertical or nearly so in the station).

A horizontal platform is provided within the station to facilitate loading and unloading of the passengers from this vertical seat back arrangement rather than requiring the passengers to lie down or requiring seat actuation (e.g., embodiments of the present coaster do not require any seat actuation to work effectively). The seating configuration taught herein and used to load on a vertical track conveniently puts the rider/passenger in a flying position when the track transitions from the vertical launch segment into a horizontal or more horizontal segment (e.g., into the ride segments or lengths of the track).

In one embodiment, the station is a stacked arrangement with one platform provided for each vehicle or car in a roller coaster train. For example, a ride system with trains made up of three vehicles (e.g., a 2 to 6 or more person vehicle) would be supported with a station having three levels for loading (and, in some cases, unloading). Each of these levels would be stacked on top of each other.

In some implementations of the ride system, the track is fixed in this vertical segment along or in the station, and the platforms are extended outward to the vehicles once they are locked in position to allow vertical loading (and unloading). The platforms then are refracted away from the vehicles and the loading segment of track prior to initiating the vertical launch of the train and the now loaded vehicles.

In another implementation, the load/vertical segment of track (or train rail) proximate to the station is selectively movable. Specifically, the vehicles are locked into a load position on the vertical track adjacent the respective platforms (loading levels), and a track positioning mechanism/assembly operates to move the track with the vehicles over to the fixed horizontal platforms. Once the vehicles are loaded, the track positioning mechanism/assembly operates to move the vertical segment of track back into alignment with the ride portions/segments of the track. Once the track is properly aligned and locked into position (e.g., the train rail is re-aligned with the main rail for launch), a launch mechanism can be used to initiate vertical launch. In both of these implementations, the platforms are positioned out of the motion envelope for the vehicles during the vertical launch (one by moving the platforms and one by moving the vehicles/train track or rail).

In this manner, the loading and unloading of the vehicles is comfortable for the passengers as they can simply sit down on the seat, lean back against a vertical seat back, and pull down a restraint harness. Also, the loading can be much more private or intimate for those entering each vehicle as each vehicle is provided its own loading platform. Each level in the station has its own car or vehicle for loading (or unloading), and other cars or vehicles are either beneath or above the vehicle in which a particular group of passengers are loading (or unloading). Each vehicle is provided a private pre-show while they wait for loading as they typically cannot see other levels, vehicles, and waiting passengers. The vertical loading with multiple platform levels provides a space savings as the loading/unloading can have a much smaller footprint as it moves the loading space vertically upwards, which is an important advantage as there is often limited real estate for providing a ride within an amusement or theme park. The vertical loading of a roller coaster also provides a new ride experience when compared with typical one-level loading (with no privacy) provided with existing flying roller coasters.

More particularly, a ride system is provided that is adapted for giving passengers a flying roller coaster experience. The ride system includes a train of vehicles, with each of the vehicles including seat assemblies that each has a seat and seat back for receiving a passenger. The ride system includes a track defining a ride path for the train of vehicles. The vehicles are supported by the track to roll along a length of the track, and the ride path is adapted for gravity-based movement of the train of vehicles in at least portions of the ride path. Significantly, the track includes a vertical segment, and the ride system includes a station including a platform assembly with two or more horizontal platforms vertically spaced-apart along the vertical segment of the track. The train is positioned on the vertical segment with each of the vehicles proximate to an end of one of the horizontal platforms for loading of the passengers in the seat assemblies.

In some embodiments, the seat backs in each of the vehicles are substantially parallel to a longitudinal axis of the track, whereby the seat backs are substantially vertical when the train is positioned on the vertical segment of the track for the loading of the passengers. In these implementations, the seat backs may be fixed or stationary in the vehicles, whereby the flying roller coaster experience is provided free of seat actuation. In other or the same embodiments, a launch assembly may be included that is configured for vertically launching the train of vehicles onto the ride path from the vertical segment of the track. To provide privacy, the station may be configured to at least partially block the passengers on one of the horizontal platforms from viewing the passengers on adjacent ones of the horizontal platforms.

According to another aspect of the ride system, the horizontal platforms may each be selectively extendable from a refracted configuration with a first length to an extended configuration with a second length greater than the first length. In such a case, when the horizontal platforms are in the extended configuration, the ends of the platforms are typically each proximate to one of the vehicles.

In some embodiments, the vertical segment of the track is first positionable in a launch position with an axis of the vertical segment aligned with axes of adjacent portions of the track and second positionable in a load position with the axis of the vertical segment spaced apart and parallel to the axes of adjacent portions of the track. In this manner, the vehicles are each proximate to one of the ends of the horizontal platforms when the vertical segment of the track is in the load position. In these embodiments, a track positioning mechanism may be included in the ride system that is configured for moving the vertical segment of the track, when the train of vehicles is supported thereon, between the launch and load positions.

DETAILED DESCRIPTION

Briefly, the present description is directed toward new embodiments for a flying roller coaster that makes use of a vertical segment (or length) of track/rail to provide both loading of vehicles and launching of the train or its vehicles into a gravity-based ride experience. To facilitate loading, a vertical run or length of track/rail (e.g., a load/launch segment of track) is provided that passes through a station. A number of levels for loading are provided in the station with stacked or tiered horizontal platforms. The vertically-oriented vehicles are locked in place adjacent to these platforms, with the seat backs also vertical (e.g., −30 to +30 degrees from a vertical plane) and with the seat assemblies facing the platforms. Passengers can load into the vertical seat assemblies by simply sitting down and pulling a restraining harness over their heads (or otherwise being secured into the vehicles).

The platforms and vehicles are then positioned in a spaced-apart arrangement with the platform out of the coaster train's motion envelope, and a launch mechanism is operated to vertically launch the train with its loaded vehicles. As discussed below, the station may be configured with an extendable and retractable platform to extend to place the horizontal platforms adjacent to the vehicles for loading (unloading) and then to retract to place the platform outside the motion profile for launching. In other embodiments, though, the load/launch segment of the track/rail with the vehicles locked onto it is moved by a track positioning mechanism out of alignment with the ride segment of the track (main rail) and into an abutting or adjacent position with the stationary horizontal platforms. Once the vehicles (in a vertical orientation) are loaded, the load/launch segment of the track is again aligned with the ride segment of the track (and, typically, mechanically locked/joined with the ends of the main rail or ride segment of the track). Then, vertical launch is initiated with the launch mechanism lifting the train to the launch point of the track where gravity and momentum take over to provide a flying roller coaster experience.

Figure 1:
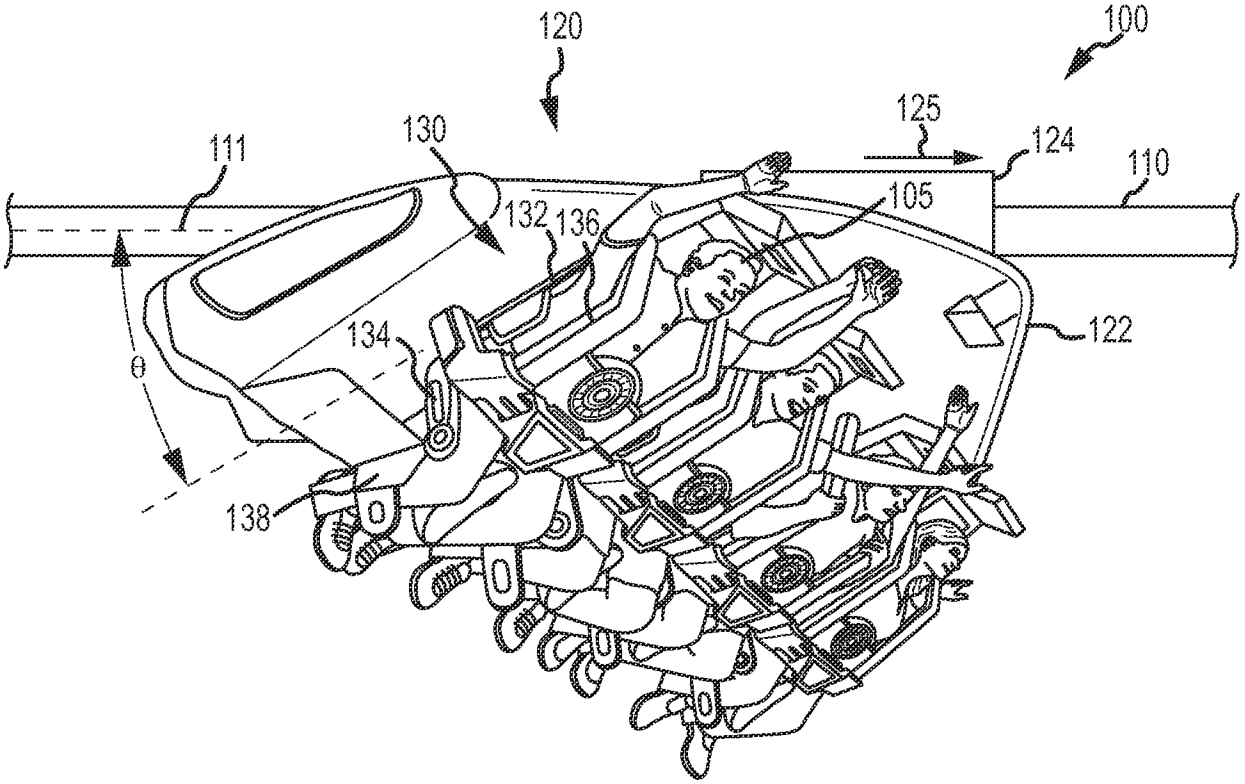
FIG. 1 illustrates a portion of a flying roller coaster (or ride system) with a vehicle (other vehicles of a train not shown for ease of description) rolling along a horizontal or ride segment or length of the ride track (or train rail)

FIG. 1 illustrates a flying roller coaster 100 of the present description in a ride section or while passengers 105 are positioned in a prone position to simulate the experience of flying. In rides such as coaster 100 taught herein, the seat back and the passenger's back typically are substantially parallel to the track or rail throughout the ride including within the station (e.g., during vertical loading). As shown, the coaster 100 includes a track or rail 110 for supporting a vehicle or car 120. The illustrated length or segment of track 110 is a ride segment of the coaster 100 as it is a horizontal (or non-vertical section) and is used to provide the flying experience to passengers 105.

To this end, the vehicle 120 includes a bogie 124 that rollably engages the track 110 and is configured to support the vehicle body 122 (e.g., via a linkage (not shown in FIG. 1) below the horizontally oriented track segment 110. During operation of the coaster 100 as shown in FIG. 1, the bogie 124 rolls 125 along the track 110 (which defines a ride path for the coaster 100 along with vehicles 120 travel due to the initial momentum and gravity) and the supported vehicle body 122 moves along with the bogie 124.

Within the vehicle body 122, a number (e.g., 2 to 6 or more) of seat assemblies 130 are provided to hold/support passengers 105. Each assembly 130 includes a seat back 132 and a seat 134 as well as a harness (upper restraint) 136 and a leg restraint (lower restraint) 138. When the passenger 105 loads into the body 122, the passenger 105 sits on seat 134 and leans his back against the seat back 132. Then, the harness/vest 136 is pulled down to their waist where it locks/engages the body 122, and the leg restraints 138 swing over to support the passenger's legs during the flying experience.

As shown, the seat back 132 is substantially parallel to the longitudinal axis 111 of the track 110. This orientation is shown with angle, θ, measured between axis 111 and a plane passing through or containing seat back 132. The flying experience may be provided by having the seat back 132 and track 110 parallel (i.e., θ at zero degrees or the angle never being formed as the seat back plane would not intersect the axis 111). However, the term "substantially parallel" is used herein because the passenger 105 may be more comfortable with the seat back 132 somewhat reclined so that their head is raised during flight 125 or when they are in the prone position. For example, the angle, θ, may be 0 to 45 degrees with 25 to 35 degrees being used in some implementations as "substantially parallel."

Significantly, the seat back 132 is kept at this substantially parallel configuration relative to the track 110 in all orientations of the track 110 including the vertical runs such as through the station for loading and launching. In other words, the seat back 132 is vertical when the track is vertical, and, due to the definition of "substantially parallel," the seat back 132 is considered vertical when the track is vertical. However, this may result in the seat back 132 actually being 0 to 45 degrees from vertical (a vertical plane coinciding with axis 111 in the station) with a common implementation being a seat back 132 at 15 to 30 degrees from the vertical plane (but this being considered as "substantially vertical" or simply "vertical" for this description).

Figure 2:
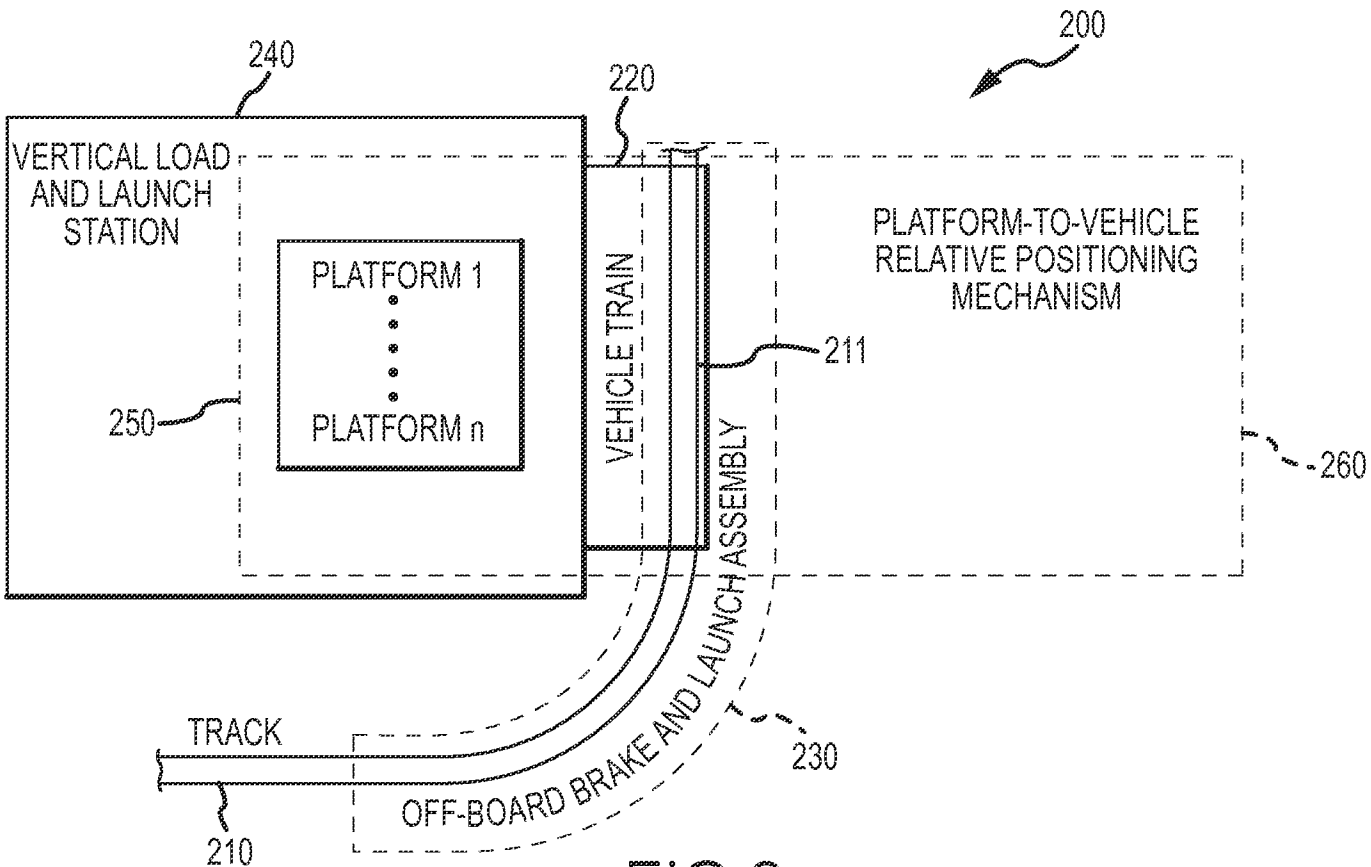
FIG. 2 illustrates with a functional block diagram a flying roller coaster showing several of the assemblies or systems used to provide the vertical loading and launching functions of the present invention.

FIG. 2 provides a functional block diagram of a flying roller coaster 200 showing several of the assemblies or systems used to provide the vertical loading and launching functions of the present invention. The coaster 200 includes a track or rail 210, and, particularly, typically will include a ride segment where a flying experience is provided and a load and launch segment or section in which loading (and unloading) occurs and from which launching is provided. As shown in FIG. 2, the track 210 includes a vertical section or length 211 to support vertical loading and launching. The length of this section or length 211 typically will be at least as long as the coaster train 220 but typically will be 50 to 100 percent or more longer (e.g., 2 to 3 times the length of the train 220) to allow a launch mechanism/assembly 230 space to move the train 220 out of a station 240 (with suspenseful build up) and then provide adequate momentum for launch.

The vehicle train 220 typically will include 2 to 6 or more vehicles, and the vehicles/cars are supported on the track 210 such as to slide or more commonly roll upon or over the track/rail 210. As shown in FIG. 1, the vehicles of train 220 may be configured with seat assemblies with a seat back for each passenger that is parallel to the longitudinal axis of the track 210 (or a plane passing through the body of the vehicle may be parallel to this axis). In this way, when the vehicle train 220 is moved into or moves due to gravity onto the vertical segment 211 of track 210, the vehicle bodies and seat backs are parallel to the track 211 and are, in other words, vertical or substantially vertical (e.g., within about 30 degrees from vertical). Hence, vertical loading is supported by the coaster 200.

The coaster 200 includes an off-board brake and launch assembly 230. Note, the brake mechanism and launch mechanism may be separate components/system or be a single unit in some embodiments. Any number of well-known and commonly used brake and/or launch mechanisms may be used in the assembly 230 to brake the train 220 at the end of a ride segment or portion of the track 210 as the train 220 is positioned within the vertical load and launch station 240. For example, the assembly 230 may include a linear synchronous motor (LSM) device, a linear induction motor (LIM), or other technology to brake the train. These or other technologies (such as a simple chain and gear assembly) may also be used to "launch" the train 220 directly from the vertical section 211 of track 210. The launching may include lifting the train 220 to a high point of the track 210 (or a ride path) and releasing the train for movement under gravity and/or the launching may include providing a motive force to cause the train 220 to achieve a particular velocity (or velocity within a range of acceptable velocities) at a launch/release point on the track 210. The assembly 230 further may function to lock or hold the vehicle train 220 on or proximate to the vertical run 211 of track 210 for loading (unloading).

The flying roller coaster 200 includes a vertical load and launch station 240, and the vertical section 211 of the track 210 passes through or adjacent to the station 240. The station 240 includes a number of horizontal platforms 250 from which passengers (not shown) may load the vehicles of the train 220. Particularly, the train 220 is locked onto the section 211 such that each of its vehicles are adjacent a platform 250. The seat backs of the seat assemblies of each vehicle typically will be parallel to the track 211 (e.g., will be vertical) and will be facing the platforms 250/station 240 such that the passengers can walk to the end of the platforms 250, turn around, and sit down on a seat with their backs to the vertical seat backs. This facilitates efficient and comfortable loading of the train 220.

The platforms 250 are stacked one above another such that a like number of loading levels are provided for the train 220 with each vehicle of train 220 being accessed from a different platform 250 (or level). For example, the train 220 may configured such that the seats of the vehicles are spaced apart about the same distance as the top surfaces of adjacent ones of the platforms 250 (e.g., if the surfaces that passengers walk upon on two adjacent platforms is 10 to 15 feet apart, the seats of two vehicles locked adjacent to these platforms for loading (or unloading) will also be 10 to 15 feet apart). This arrangement or design of coaster 200 allows for a private setting or environment for loading as each vehicle's passengers are provided their own pre-show/waiting experience and cannot (typically) see other passengers during loading.

The coaster 200 includes a platform-to-vehicle relative positioning mechanism 260. In some embodiments of coaster 200, the positioning mechanism 260 is configured to cause the platforms 250 to extend outward toward the track segment 211 and a set of locked-in-place vehicles to place the end or outer edge of the platform adjacent or under the vehicles of train 220. Once loading is completed, the positioning mechanism 260 may then retract each of the platforms 250 to place them outside the motion envelope of the vehicle train 220 to allow launching to safely proceed. In a similar embodiment, the platforms 250 are configured as drawbridge-type platforms, and the positioning mechanism 260 acts to selectively pivot the platforms up after loading is complete and down to place the platforms 250 next to the vehicles of train 220.

In another embodiment, though, the platforms 250 are stationary, and the positioning mechanism 260 functions to move the vertical segment 211 (or a portion thereof) and train 220 away from the ride segment of track 210 to a position proximate to the ends (or outer edges/sides) of platforms 250 for loading and unloading. In this embodiment, the track 211 is moved horizontally to be out of alignment with opposite ends of the ride segment of track 210 for loading/unloading of the train 220 and then returned to an aligned position with track 210 prior to operating the launch assembly 230 to move the train 220 out of the station and providing a vertical launch.

Figure 3:
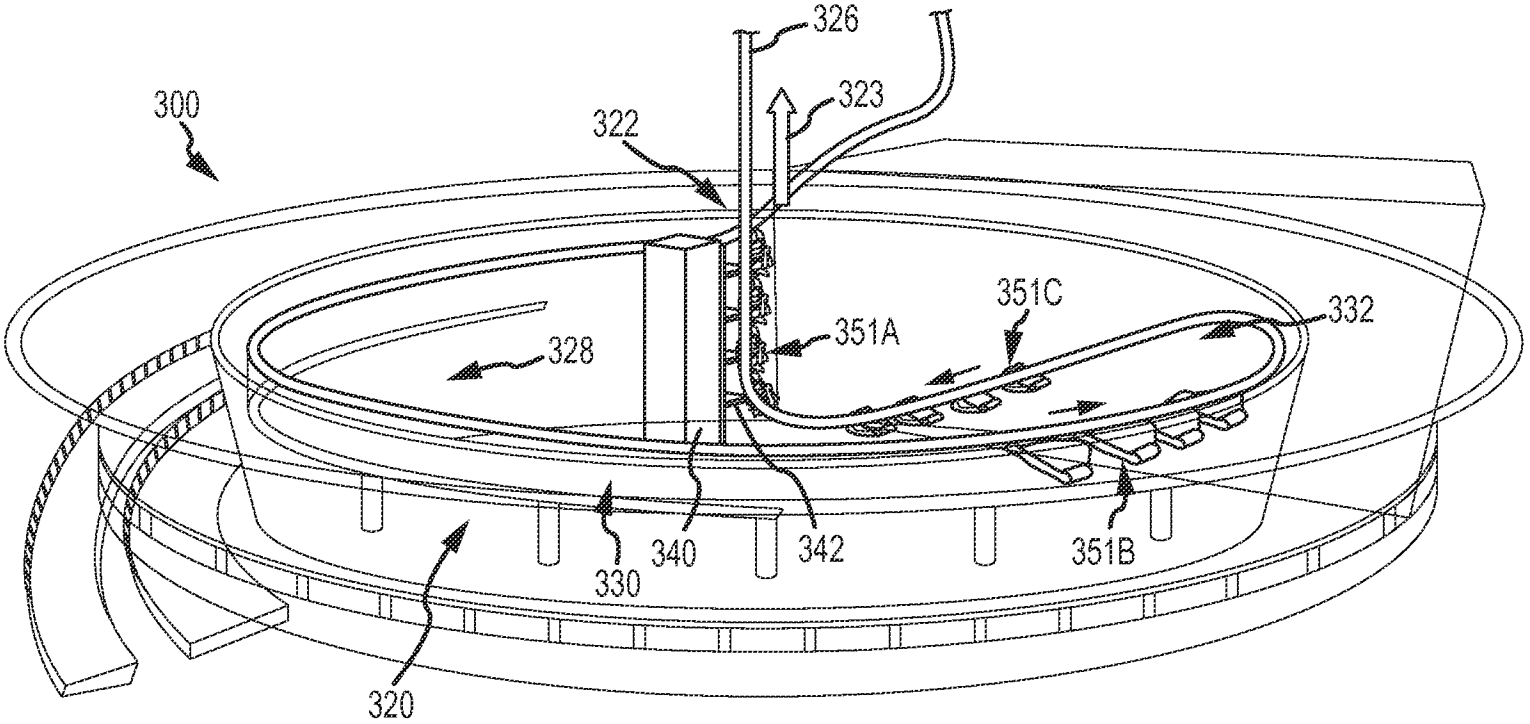
FIG. 3 illustrates a schematic of a flying coaster ride (with an abbreviated or simplified ride segment) showing use of a vertical load and also a vertical launch to provide a new ride experience.

FIG. 3 provides a simplified schematic or partial perspective view of a model or exemplary flying roller coaster 300 that may be used to implement the ideas taught herein. The coaster or ride system 300 includes a track or train rail 320 that defines a ride path for passenger vehicles (e.g., coaster cars configured to capture and roll upon the rail 320 and to securely seat or hold 2 to 8 or more passengers with their backs substantially parallel to the rail 320). The ride path may be thought of as being divided into a number of segments or portions, with each segment providing a different aspect or feature of the ride experience provided by the coaster 300.

Particularly, as shown in FIG. 3, the track or rail 320 is divided up into a load/unload and vertical launch segment 322 in which the rail 320 is oriented to be vertical (or substantially so such as −30 to +30 degrees from a vertical plane but more typically −5 to +5 degrees from vertical). A train 351A of passenger vehicles is shown to be in this first segment 322 adjacent to a station structure 340. Horizontal platforms 342 are shown to extend outward within (or from) the station structure 340 to the vehicles of train 351A. The platforms 342 are shown to define four spaced-apart levels for loading (and unloading) the train 351A, which provides privacy and a different ride experience as other coasters load on a single level.

The number of platforms 342 matches the number of vehicles in the train 351A (four vehicles and platforms in this exemplary, but not limiting, example), e.g., one platform is dedicated for use with one vehicle in the train 351A (e.g., the lead car/vehicle is paired with the top or highest level defined by platforms 342 and so on, and a passenger may, in some cases, be able to select the platform 342 to achieve a particular ride experience (e.g., first car versus last car in a train 351A to obtain a desired ride experience). Once the vehicles of train 351A are unloaded and then loaded via the platforms 342 (which may extend out to the vehicles or the track segment 322 may be moved to the platforms 342), the train 351A can be launched as shown with arrow 323 using the vertical run or segment 322 of rail/track 320.

Once launched, the train 351A travels out of the vertical segment 322 of track 320 into a ride segment 326. The length and design of this segment 326 is not shown explicitly in FIG. 3, and it may vary widely to practice the coaster 300 such as by including a number of curves, dips, and twists as is common in coaster rides. Typically, though, the ride segment 326 will include a curve and twist to place the vehicles of train 351A and its passengers in a flying position. The vehicles may be vertically oriented in the station 340 with the seat assemblies facing toward the station platforms 342 and with seat backs generally vertical for load/unload. Then, a forward curve into a horizontal run can be provided in ride segment 326 to place the vehicles in the flying position such that the seat backs are oriented in a horizontal manner. Many other designs for placing the vertically launched vehicles of train 351A in flying positions will be readily apparent to flying coaster designers, and ride segment 326 may include any of these designs.

After or towards the end of the ride segment 326, the track or rail 320 includes a return portion or segment 328 (which may be at an elevation higher than the levels/platforms 342 of the station 340 to allow gravity to move the trains to the station 340). Trains 351B and 351C (e.g., train 351A toward the end of a ride or operation of coaster 300) are shown to be moving through the return segment 328, which may include a final scene 330 and a transition 332, prior to entering the station 340 for unloading via platforms 342. A brake and launch assembly (not shown but may be as described with reference to FIG. 2) may be used to brake and capture the train 351C and move it to the load/unload position shown at 351A (e.g., with a vehicle oriented vertically or parallel to vertical segment 322 of track 320 and adjacent and with the seat and seat back of each passenger at an elevation over the top of a corresponding one of the platforms 342 for ergonomically acceptable/desirable loading/unloading from the vehicles).

Figure 4A:
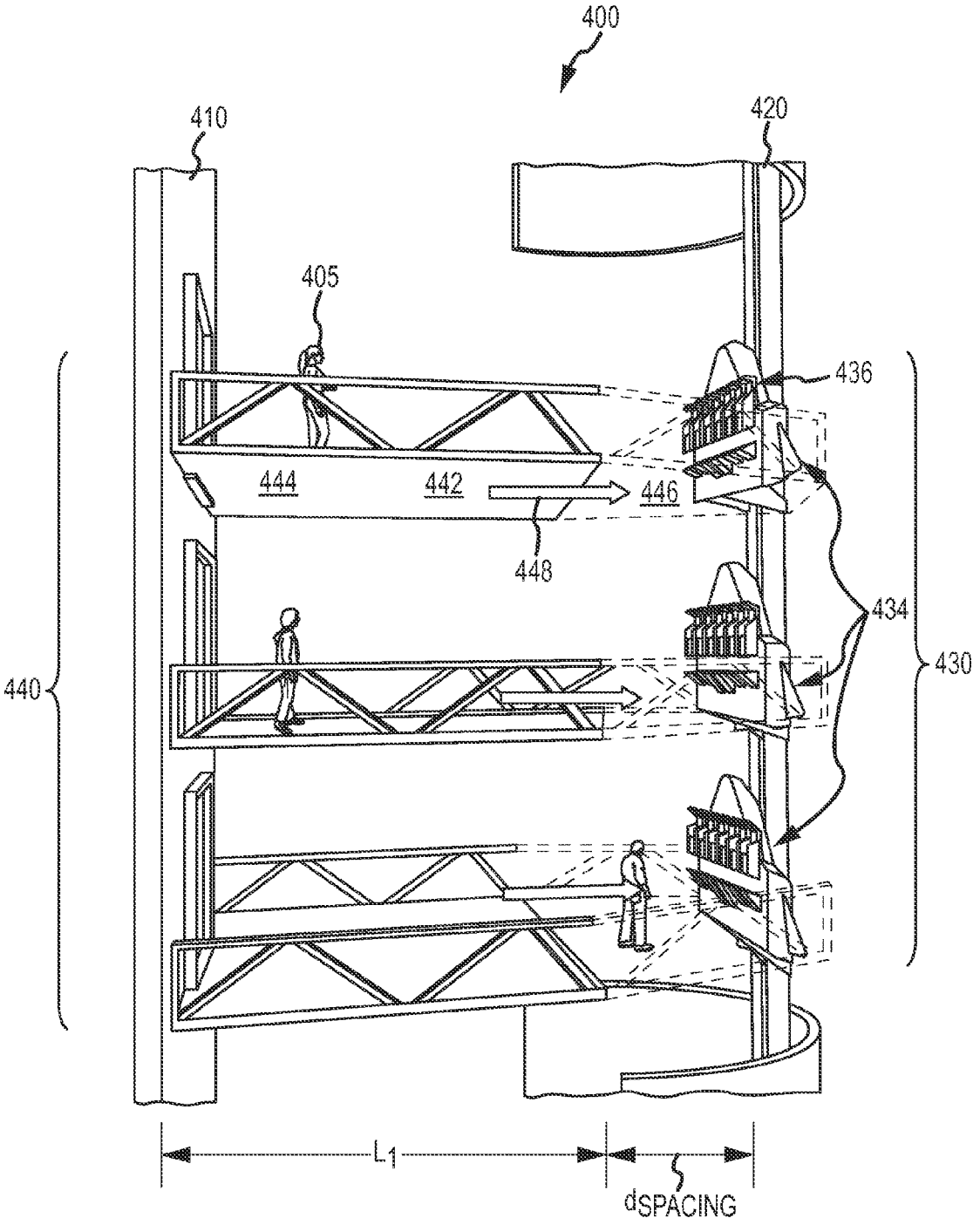
FIGS. 4A and 4B illustrate a station design that facilitates vertical loading/unloading and coaster train launching out of the station.
Figure 4B:
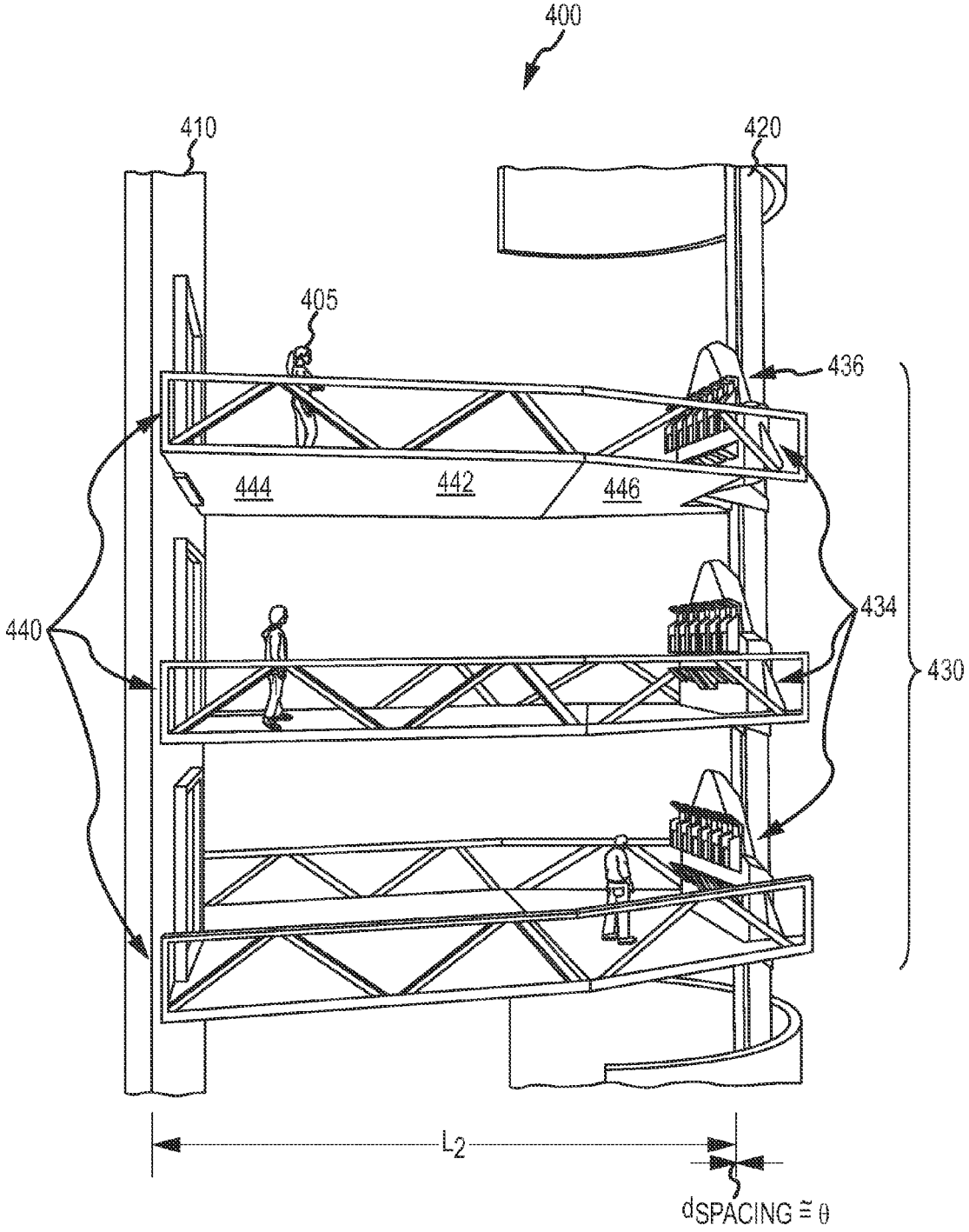

FIGS. 4A and 4B illustrate a station 400 that is designed to facilitate vertical loading/unloading and coaster train launching out of the station 400. Particularly, FIG. 4A shows the station 400 during an initial loading operation (unloading not shown/required at this point in operations) while FIG. 4B shows the station immediately prior to vehicle loading by passengers 405 (e.g., with platforms properly positioned relative to train vehicles or cars).

Turning first to FIG. 4A, the station 400 is shown to include a support structure 410 that is adapted to physically support a platform set or assembly 440. The platform assembly 440 is configured with a number of extendable/retractable platforms such as upper platform 442. Upper platform 442 is shown in a first configuration (refracted configuration), and the platform assembly 440 may operate (e.g., with an extension/retraction mechanism or the like (not specifically shown)) to place the platform 442 in this refracted configuration after loading is complete so as to move the platform 442 out of the motion envelope of a coaster ride.

As shown, the platform 442 is a horizontal structure with a first end 444 attached to or abutting the support structure 410 and a second end 446 distal from the support structure 410. In the refracted configuration shown, the platform 442 has a first or refracted length, $L_1$, as measured between the first and second ends 444, 446, and the second end 446 is spaced apart a distance, $d_{spacing}$, from the rail 420 (e.g., so as to avoid interference between the vehicles 434 of train 430 and the platform 442 with an adequate factor of safety). The refracted length, $L_1$, and width (and shape) are design choices used to provide a desired pre-ride experience/show and to support the passenger capacity of the vehicles 434, with a single passenger 405 shown waiting on the platform 442 to load. Interestingly, the platform assembly 440 includes a number of platforms 442 that are vertically spaced apart to define a like number of loading/unloading levels for a coaster train 430 (i.e., the station 400 includes a multi-level loading platform). The number of levels/platforms 442 is chosen, typically, to match the number of vehicles 434 in a coaster train 430.

As shown, a run or segment 420 of a ride track or rail passes vertically through the station 400. Prior to loading, as shown, a coaster train 430 is moved (such as with a brake and launch assembly (not shown in FIG. 4A)) into position on the vertical track segment 420. In this loading position (and unloading position), each vehicle/car 434 in the train 430 is placed adjacent to one of the platforms 442. To initiate loading, the platform assembly 440 operates (again such as with an extend/retract mechanism provided for each platform 442) to extend or telescope out the end of the platform 442 (and other platforms) as shown with arrow 448 toward the vertical track segment 420 and vehicles 434 of locked train 430.

FIG. 4B shows the station after the extending of the platforms 442 has been completed and loading of passengers 405 may begin for train 430. As shown, the platform 442 now has a second or extended length, $L_2$, that is significantly greater than the refracted length, $L_1$. For example, the platform end 446 may be extended outward toward the vertical segment 422 by 5 to 15 feet or more in some cases. The spacing or separation distance, $d_{spacing}$, between end 446 and the rail 442 (or to base of vehicle 434) may be 0 to a few feet, and, in some cases, the end 446 may be underneath the vehicle 434 or abutting a lower portion of the vehicle 434.

The vehicle 434 includes a number of seat assemblies 436, and, in the illustrated loading orientation, the seat backs of these assemblies 436 are substantially vertical (parallel to rail 420) to support loading the passengers 406 into the vehicle 434. As shown, the seat backs of assemblies 436 face the platform 442 and structure 410 such that passengers 405 can walk out on platform 442 and sit down and pull down a restraint/harness to lock themselves into the vehicle 434. In other words, the station 400 is adapted to provide vertical loading. No actuation is required for the seat assemblies 436, but some embodiments may include actuation to provide some adjustment of the seat back or other components of the seat assembly 436 before and/or after loading.

Once loading is complete and the passengers 405 are properly restrained in the vehicles 434 of train 430, the second end 446 of the platform 444 is refracted by the platform assembly 440 (or a retraction mechanism provided in the assembly 440) toward the support structure 410 to return it to the refracted configuration shown in FIG. 4A (with the first length, $L_1$). Then, vertical launch may proceed with a launch mechanism (not shown in FIG. 4A or 4B, but may be implemented as described with reference to FIG. 2, for example) acting to move train 430 vertically up and out of the station along the vertical track run or segment 420.

Figure 5A:
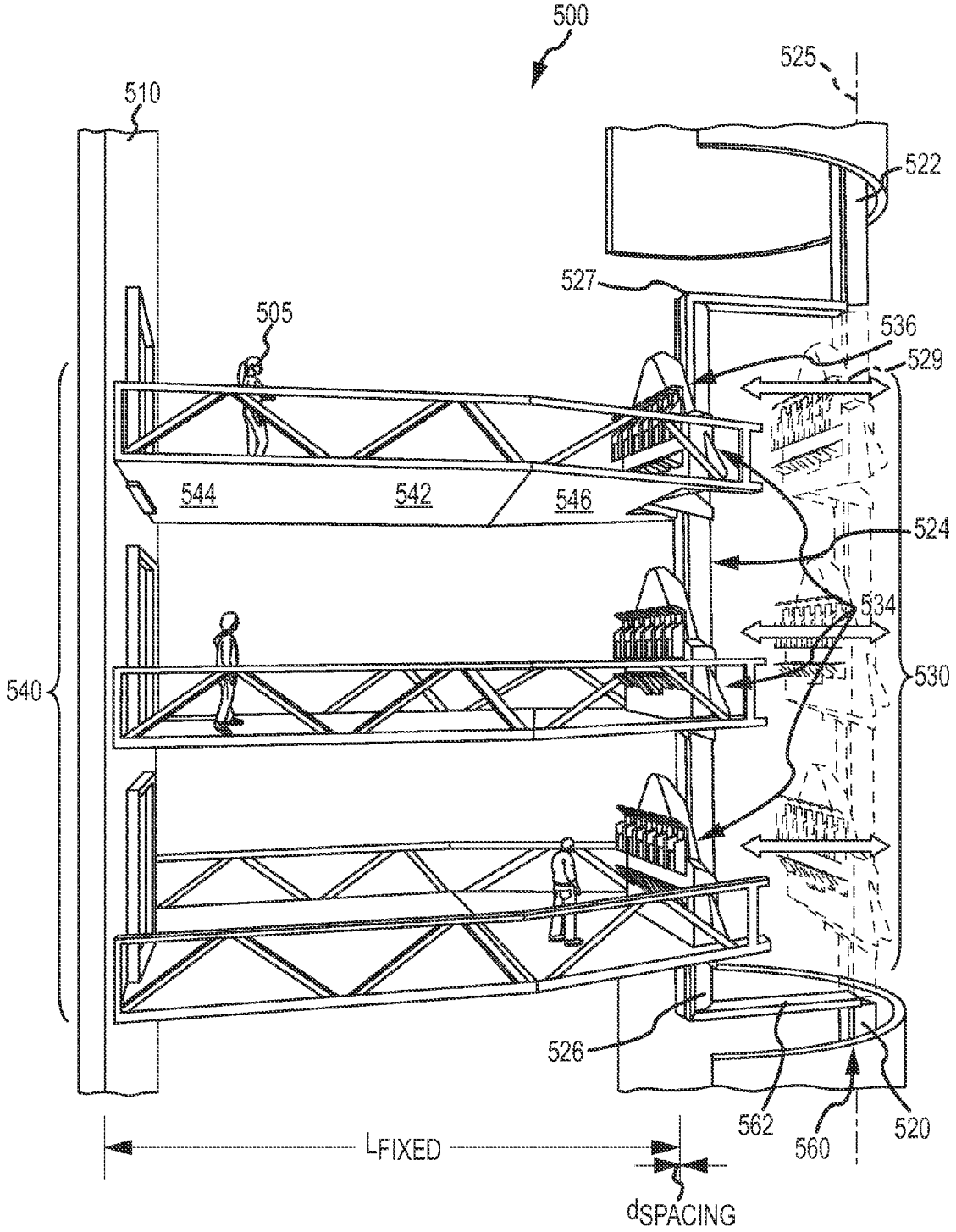
FIGS. 5A and 5B illustrate, similar to FIGS. 4A and 4B, a station design that provided vertical loading/unloading and launching of vehicle trains, with the station differing from that of FIGS. 4A and 4B in that it is configured to selectively position a vertical segment of track with the platforms remaining fixed in place.
Figure 5B:
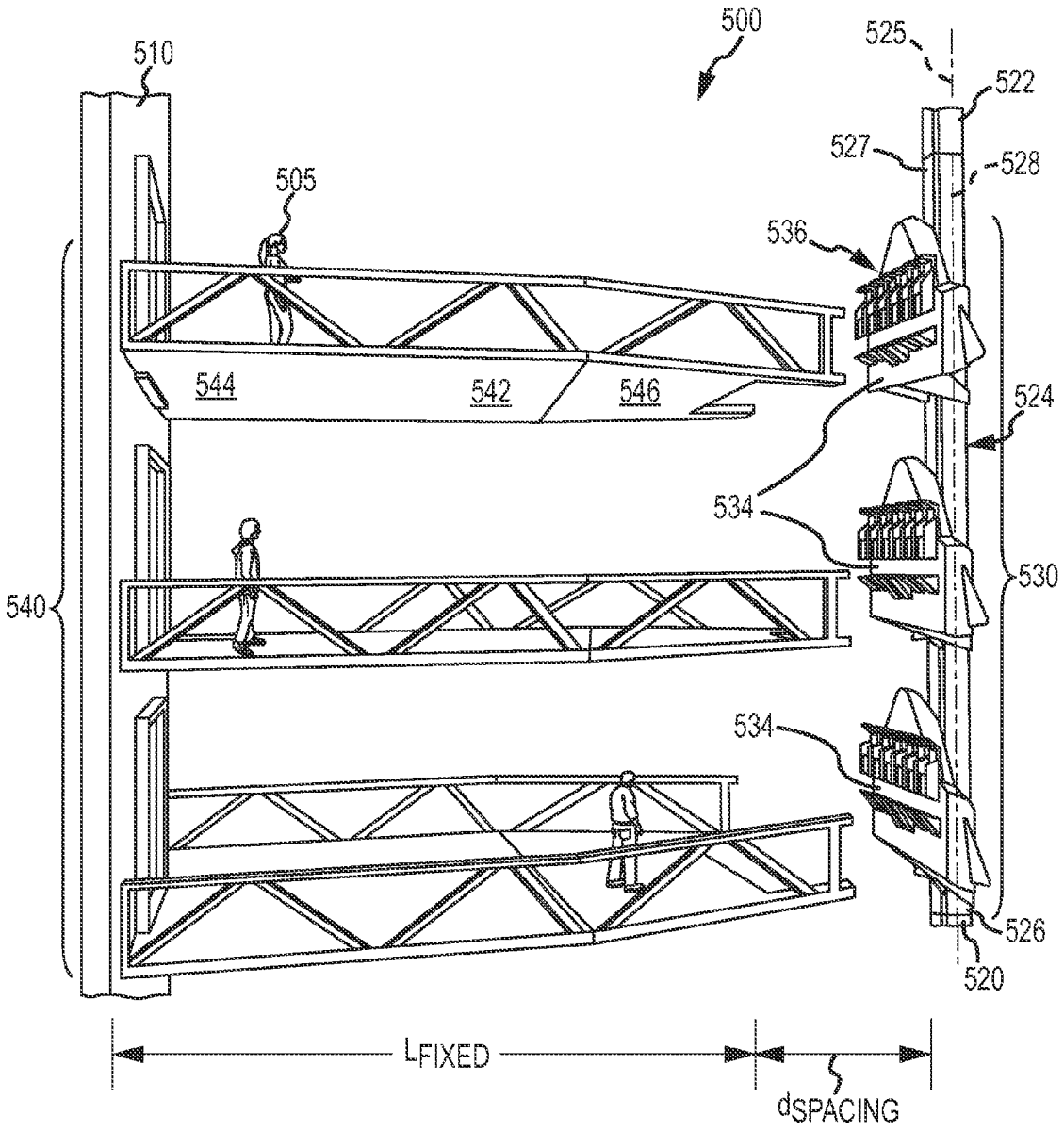

FIGS. 5A and 5B illustrate a flying roller coaster station 500 adapted for vertical load/unload and for vertical vehicle or train launch. The station 500 differs from station 400 in that the platforms are fixed in place, and the vehicles/train locked on a track segment are moved relative to these fixed platforms to support loading and then vertical launch from the station 500. Similar to station 400, the station 500 includes a support structure 510 that is used to physically support a platform assembly 540 within a flying roller coaster or ride system (such as within system 300 of FIG. 3).

The platform assembly 540 includes a number of horizontal platforms 542 that extend out from the structure 510 toward a ride track/rail. Particularly, a first end 544 is attached to the support structure 510 and a second end 546 is distal to the structure 510 (e.g., the platform 542 is a cantilevered member relative to the structure 510). The platforms 542 have a number that matches a number of vehicles 534 in train 530 and define a multi-level loading/unloading arrangement (with the platforms 542 vertically offset or stacked). The platform 542 has a length, $L_{fixed}$, that is fixed or unchanging during operation of the station 500 (in contrast to platform 442 of station 400).

FIG. 5A shows the station 500 in a load/unload configuration or operating state. In this configuration, a track segment positioning (or aligning) mechanism 560 is operated to move 529 a vehicle track segment 524 out of alignment with an axis, $Axis_{Rail}$, of the main rail/track. This can be seen as the track segment ends 526, 527 are unlocked from and moved apart from ends 520, 522 of the main track/rail (which provides the ride segment of the coaster ride). Particularly, the mechanism 560 acts to slide 529, on guide element 562 or the like, the rail segment 524 toward the platforms 542 until the rail 524 or vehicles 534 are proximate to or abutting the ends 546 of the horizontal platforms 542 of platform assembly 540.

When positioned as shown in FIG. 5A, the vehicles 534 may be accessed by a passenger 505 for loading (or unloading), with the train 530 locked or secured in place on the track segment 524. The vehicles 534 include a seat assembly 536, with the seat back facing the platform 542 and in oriented vertically (i.e., substantially parallel to the axis, $Axis_{Seg}$, of the rail segment 524, which is vertical). The spacing, $d_{spacing}$, between the end 546 of the platform 542 and the track segment 524 (or vehicle 534 in some cases) is substantially zero (e.g., 0 to 3 feet or the like), and the passenger 505 can sit on the seat assembly 536 when at the end 546 of the platform 542.

Once loading is complete and passengers 505 are securely restrained in the seat assemblies 536 of vehicles 534, the track segment positioning and alignment mechanism 560 may again be operated to move or slide 529 the track segment 524 on guide element 562. The movement 529 is continued until the track segment 524 has its ends 526, 527 adjacent and/or nearly abutting main track ends 520, 522. The track segment 524 can be locked in this position mechanically by assembly 560 or other equipment.

In this launch configuration or operating state, as shown in FIG. 5B, the spacing, $d_{spacing}$, between the platform end 546 and the track segment 524 has increased to a value that places the end 546 outside the motion envelope of the train 530 (with a desired factor of safety). In this position, the track segment 524 has its axis, $Axis_{Seg}$, (shown with dashed line 528) aligned or colinear with the main axis, $Axis_{Rail}$, (shown with dashed line 525) of the rail with ends 520, 522. Once the track segment 524 is positioned in proper alignment with the main track associated with ends 520, 522, a launch mechanism can be operated or engaged to vertically move or launch the train 530 of vehicles 534 up and out of the station 500.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A ride system for providing a flying roller coaster experience, comprising: a train of vehicles, wherein each of the vehicles includes seat assemblies each including a seat and seat back for receiving a passenger; a track defining a ride path for the train of vehicles, wherein the vehicles are supported by the track to roll along a length of the track, wherein the ride path is adapted for gravity-based movement of the train of vehicles in at least portions of the ride path, and wherein the track includes a vertical segment; and a station including a platform assembly with two or more horizontal platforms vertically spaced-apart and positioned adjacent to the vertical segment of the track and wherein the train is positioned on the vertical segment with each of the vehicles proximate to an end of one of the horizontal platforms for loading of the passengers in the seat assemblies, wherein the horizontal platforms are each selectively extendable from a retracted configuration with a first length to an extended configuration with a second length greater than the first length.

2. The ride system of claim 1, wherein the seat backs in each of the vehicles are substantially parallel to a longitudinal axis of the track, whereby the seat backs are substantially vertical when the train is positioned on the vertical segment of the track for the loading of the passengers.

3. The ride system of claim 2, wherein the seat backs are stationary in the vehicles, whereby the flying roller coaster experience is provided free of seat actuation.

4. The ride system of claim 1, further comprising a launch assembly for vertically launching the train of vehicles onto the ride path from the vertical segment of the track.

5. The ride system of claim 4, wherein, when the horizontal platforms are in the extended configuration, the ends of the platforms are each proximate to one of the vehicles.

6. The ride system of claim 1, wherein the vertical segment of the track is first positionable in a launch position with an axis of the vertical segment aligned with axes of adjacent portions of the track and second positionable in a load position with the axis of the vertical segment spaced apart and parallel to the axes of adjacent portions of the track, the vehicles each being proximate to one of the ends of the horizontal platforms when the vertical segment of the track is in the load position.

7. The ride system of claim 6, further including a track positioning mechanism for moving the vertical segment of the track, when the train of vehicles is supported thereon, between the launch and load positions.

8. The ride system of claim 1, wherein the station is configured to at least partially block the passengers on one of the horizontal platforms from viewing the passengers on adjacent ones of the horizontal platforms.

9. A flying roller coaster, comprising: a vertical run of track; a ride segment of track connected to the vertical run of track; a plurality of roller coaster cars positioned on the vertical run of track, wherein the roller coaster cars include seat assemblies each having a seat back that is parallel to the track; and a launch mechanism for engaging the roller coaster cars in the vertical run of track and launching the roller coaster cars, whereby the flying roller coaster provides a vertical launch, further comprising a plurality of platforms provided adjacent the vertical run with an end proximate to the roller coaster cars positioned on the vertical run of track, whereby vertical loading and unloading is provided for the roller coaster cars.

10. The flying roller coaster of claim 9, wherein the platforms are each extendable from a retracted position to an extended position with a greater length, the roller coaster rides being spaced apart from the ends of the platforms with the platforms in the retracted position.

11. The flying roller coaster of claim 9, further including a track positioning mechanism moving the vertical run of track from a first position used during the vertical launch to a second position used for the vertical loading, wherein the vertical run of track has an axis that is aligned with an axis of the ride segment of the track at an end mating with an end of the vertical run of track in the first position.

12. A ride system, comprising: a train of vehicles, wherein each of the vehicles includes seat assemblies each including a seat for receiving a passenger; a track defining a ride path for the train of vehicles, wherein the vehicles are supported by the track to roll along a length of the track, wherein the ride path is adapted for gravity-based movement of the train of vehicles in at least portions of the ride path, and wherein the track includes a vertical segment; a station including a platform assembly with two or more horizontal platforms vertically spaced-apart and positioned adjacent to the vertical segment of the track and wherein the train is positioned on the vertical segment with each of the vehicles proximate to an end of one of the horizontal platforms for loading of the passengers in the seat assemblies; and a launch assembly for vertically launching the train of vehicles onto the ride path from the vertical segment of the track, wherein the horizontal platforms are each selectively extendable from a retracted configuration with a first length to an extended configuration with a second length greater than the first length.

13. The ride system of claim 12, wherein each of the seats includes a seat back and wherein the seat backs in each of the vehicles are substantially parallel to a longitudinal axis of the track, whereby the seat backs are substantially vertical when the train is positioned on the vertical segment of the track for the loading of the passengers.

14. The ride system of claim 13, wherein the seat backs are stationary in the vehicles, whereby the flying roller coaster experience is provided free of seat actuation.

15. The ride system of claim 12, wherein the station is configured to at least partially block the passengers on one of the horizontal platforms from viewing the passengers on adjacent ones of the horizontal platforms.

16. The ride system of claim 12, wherein, when the horizontal platforms are in the extended configuration, the ends of the platforms are each proximate to one of the vehicles.

17. The ride system of claim 12, wherein the vertical segment of the track is first positionable in a launch position with an axis of the vertical segment aligned with axes of adjacent portions of the track and second positionable in a load position with the axis of the vertical segment spaced apart and parallel to the axes of adjacent portions of the track, the vehicles each being proximate to one of the ends of the horizontal platforms when the vertical segment of the track is in the load position.

18. The ride system of claim 17, further including a track positioning mechanism for moving the vertical segment of the track, when the train of vehicles is supported thereon, between the launch and load positions.

* * * * *

UNITED STATES PATENT AND TRADEMARK OFFICE

CERTIFICATE OF CORRECTION

PATENT NO. : 8,943,976 B2
APPLICATION NO. : 13/716509
DATED : February 3, 2015
INVENTOR(S) : Nicholas J. Comorre It is certified that error appears in the above-identified patent and that said Letters Patent is hereby corrected as shown below:

In the Specification

Column 2, line 58, delete “refracted” and insert therefor --retracted--.

Column 3, line 65, delete “refracted” and insert therefor --retracted--.

Column 9, line 6, 7, 11, 39, 61, and 63, delete “refracted” and insert therefor --retracted--.

Signed and Sealed this
Twelfth Day of May, 2015

Michelle K. Lee

Michelle K. Lee
*Director of the United States Patent and Trademark Office*